United States Patent [19]

Portasik

[11] 4,452,582

[45] Jun. 5, 1984

[54] INDEPENDENT, SELF-CONTAINED ELECTRONIC SPARK IGNITION RECYCLER

[76] Inventor: John P. Portasik, 1119 Anesbury La., Alexandria, Va. 22308

[21] Appl. No.: 389,765

[22] Filed: Jun. 18, 1982

[51] Int. Cl.[3] ..... F23N 5/00

[52] U.S. Cl. ..... 431/27; 431/70

[58] Field of Search ..... 431/18, 27, 70; 307/117; 126/116 A

[56] References Cited

U.S. PATENT DOCUMENTS

| | | | |
|---|---|---|---|
| 3,196,923 | 7/1965 | Selinder | 431/70 |
| 4,303,385 | 12/1981 | Rudich, Jr. et al. | 431/70 |
| 4,325,689 | 4/1982 | Burke | 431/70 |

FOREIGN PATENT DOCUMENTS

| | | | |
|---|---|---|---|
| 52-51120 | 4/1977 | Japan | 431/31 |

*Primary Examiner*—Lee E. Barrett

*Attorney, Agent, or Firm*—Roger P. Glass; Leon Zitver

[57] ABSTRACT

An electronic spark ignition system for a heating apparatus which does not have a means of attempting repeated ignition attempts if prior attempts at ignition fail is forced into a recycling mode by an independent, self-contained electronic spark ignition recycler. The recycler includes a temperature sensor for detecting output temperature of the heating apparatus, an on/off circuit for activating and deactivating that circuit, a timing determines the length of time allocated for recycling, a triggerable bidirectional switch to force the electronic spark ignition into a repeat mode, and a means for deactivating the recycler after a predetermined condition is met. The temperature sensor activates the timer which periodically triggers the bidirectional switch until ignition occurs or until the recycler is deactivated. Installation of the recycler requires a simple connection of the two terminals of the bidirectional switch to either a wire from the heat demand switch (or thermostat) or a wire from the electronic spark ignition reset switch.

8 Claims, 5 Drawing Figures

INDEPENDENT, SELF-CONTAINED ELECTRONIC SPARK IGNITION RECYCLER

LIST OF PRIOR ART SUBMITTED BY APPLICANT

U.S. PATENT DOCUMENTS

| | | | |
|---|---|---|---|
| 4,325,689 | 4/1982 | Burke | 431-27 |
| 3,582,249 | 6/1971 | Hodgson | 431-70 |
| 3,529,910 | 9/1970 | Potts, et. al. | 431-70 |
| 3,446,565 | 5/1969 | Hantack | 431-70 |

FOREIGN PATENT DOCUMENTS

| | | | |
|---|---|---|---|
| 2,018,972 | 10/1979 | United Kingdom | 431-70 |
| 1,957,920 | 6/1970 | Fed. Rep. of Germany | 431-70 |

BACKGROUND OF THE INVENTION

The present invention relates to any heating apparatus that relies on an electronically controlled spark ignition system. More particularly, the present invention relates to an independent, self-contained means of recycling the electronic module logic when the spark ignition system fails to ignite the fuel and when the electronic module logic is resetable by temporarily lowering the temperature setting of the temperature activated switch (or thermostat) or by temporarily interrupting the source of power to the module or a control line, or by short circuiting a specific control line.

Conditions, such as temporary low fuel pressure, could be imcompatible with the normal operation of a heating apparatus that relies on an electronically controlled spark ignition system. This incompatibility often results in the heating apparatus entering a latch-up mode that prevents normal operation from being achieved. Owners of such heating apparatus must either make provisions to manually reset the electronic module logic, or make provisions to incorporate an automatic reset control which must be installed by one who has access to all necessary schematic diagrams and who has the necessary knowledge required to properly implement the automatic reset control.

SUMMARY OF THE INVENTION

The present invention provides an inexpensive, simply installed means of recycling the electronic module logic to allow multiple ignition attempts. This is accomplished by providing a recycler for causing the electronic spark ignition to periodically attempt fuel ignition until ignition occurs or until some predetermined condition is met, at which time the recycler is deactivated. The recycler includes a temperature sensor means for detecting output temperature of the heating apparatus, an on/off circuit means for activating and deactivating a timing circuit means that determines the length of time allocated for recycling, a triggerable bidirectional switch responsive to said timing circuit means to cause said system's logic to recycle to its initial state, and a means for deactivating the recycler after a predetermined condition is met. Installation of the recycler requires a simple connection of the two terminals of the bidirectional switch to either a wire from the heat demand switch (or thermostat) or a wire from the electronic spark ignition reset switch.

DESCRIPTION OF THE PREFERRED EMBODIMENTS

Figure 1:
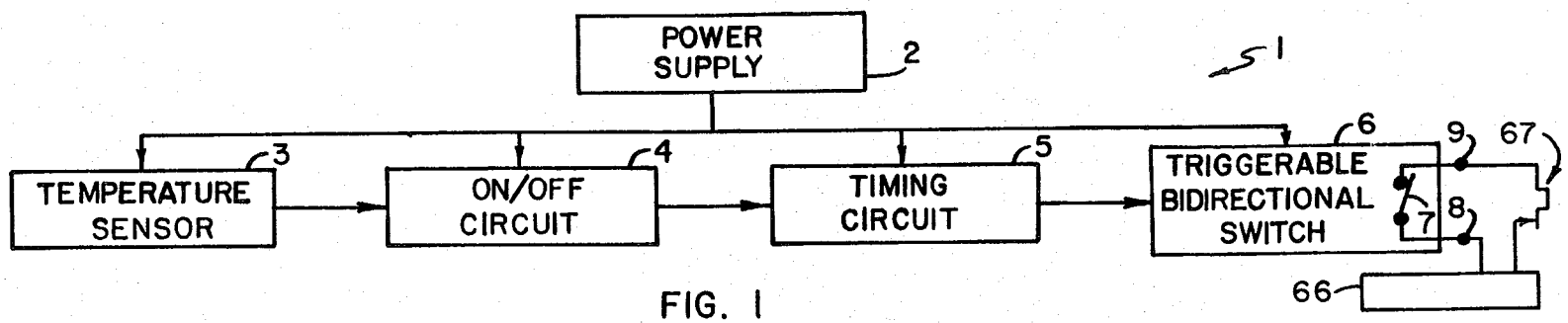
FIG. 1 is a block diagram of the recycler of the present invention.

Referring to FIG. 1, a heating apparatus 66 with , an electronically controlled spark ignition system that has achieved a latch-up mode can have its logic recycled by temporarily activating the triggerable bidirectional switch 6 whose contact 7 provides a normally closed connection between terminals 8, 9 thus replacing either the temporary lowering of a temperature activated switch or thermostat 67 temperature setting or the activation of a reset switch on a heating apparatus which opens a normally closed circuit. (It should be understood that if a reset device on a heating apparatus functions by temporarily shorting two terminals, then the triggerable bidirectional switch 6 is connected in the normally open mode.) Diverting either electrical line going between the temperature activated switch, or thermostat 67, and the heating apparatus 66 through terminals 8, 9 is the only connection that must be made in most instances to install the recycler of this invention. At times, it may be necessary to divert either electrical line going to the reset switch on a heating apparatus through terminals 8, 9.

Referring to FIG. 1, the independent, self-contained electronic spark ignition recycler 1 includes a power supply 2, a temperature sensor 3 for detecting output temperature of the heating apparatus, an on/off circuit 4 for activating and deactivating a timing circuit 5 that, determines the length of time that a contact 7 of the triggerable bidirectional switch 6 should be open and the length of time it should be closed, which in turn determines a time allocated for recycling the logic of the spark ignition system of the heating apparatus 66 to its initial state.

Figure 2:
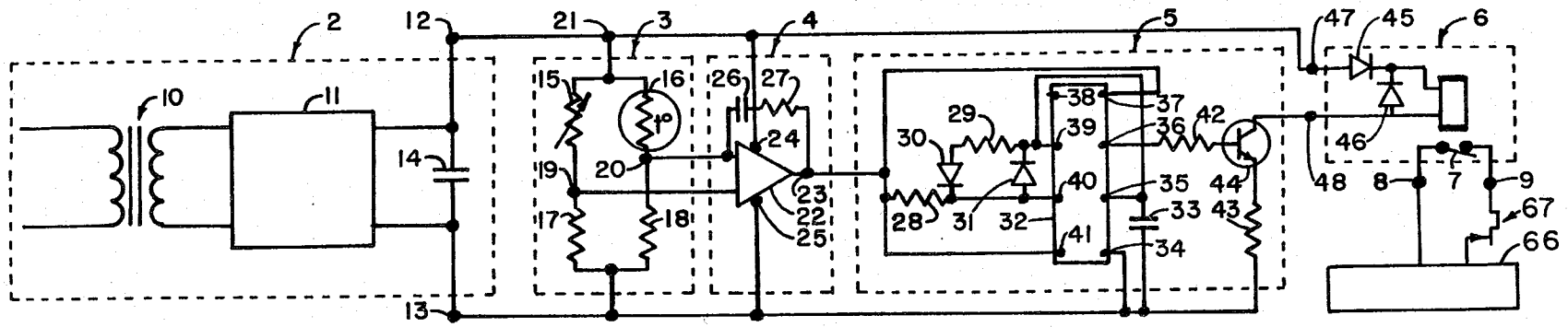
FIG. 2 is a circuit diagram of the present invention that corresponds to the block diagram in FIG. 1.

Referring to FIG. 2, a thermister 16 is placed in a position where it will detect an increase in temperature when the heating apparatus 66 is operational. If the heating apparatus 66 ignition fails to occur, thermister 16 will also be in a position to detect a decrease in temperature below that which is selected on the thermostat 67 connected to and controlling the heating apparatus 66. For example, this could be in a heating duct or in the path of heat flow in the case of a household or greenhouse furnace. If the heating apparatus 66 is operating normally, the temperature environment near the thermister 16 will remain above some value as determined by the setting of the heating apparatus's temperature activated device, or thermostat 67. In this case, the resistance of thermister 16 is lower than the preselected resistance 15 and the voltage at terminal 20 is positive with respect to terminal 19. An operational amplifier 22 is connected so that its output voltage at terminal 23 is zero under these aforementioned conditions. Thus, the output voltage at terminal 36 of timing chip 32 is zero, transistor 44 is not conducting, the voltage across terminals 47, 48 is zero, contact 7 is in its normally closed position, and the heating apparatus 66 is allowed to function in its normal manner. When the temperature environment at the thermister 16 goes below a preselected value indicating that the heating apparatus 66 has malfunctioned and is in a latch-up mode, the resistance of the thermister 16 goes above the preselected resistance 15 and the voltage at terminal 20 goes negative with respect to terminal 19. A positive voltage appears at the output terminal 23 of the operational amplifier 22. The positive voltage at terminal 23 activates the timing chip 32 which in this case is configured for astable operation. During the on cycle of the timing chip 32, a positive voltage exists at terminal 36 and transistor 44 conducts. This allows a potential difference to exist between terminals 47 and 48 and the triggerable bidirectional switch 6 is activated. Contact 7 opens causing an open circuit between terminals 8, 9. (If a reset condition required shorting terminals 8, 9, the triggerable bidirectional switch would be connected in a normally open mode). The heating apparatus 66 is turned off causing the electronic ignition module logic to recycle to its initial state. After a period of time determined by the selection of the timing circuit 5 components, the output voltage at terminal 36 of timing chip 32 goes to zero, transistor 44 stops conducting, the voltage across terminals 47, 48 goes to zero, and contact 7 closes. Thus, the heating apparatus 66 is allowed to again attempt an ignition just as if the temperature activated switch 67 of the heating apparatus 66 were temporarily turned down (i.e., down, then up) or as if the reset switch were activated. If the ignition is successful, the heat rise at thermister 16 causes the voltage at terminal 20 to go positive with respect to terminal 19 and all circuits subsequent to these two terminals are deactivated and normal operation will ensue. If the ignition is unsuccessful, no heat rise at thermister 16 is sensed and the timing circuit 5 continues to operate in its astable mode. After a period of time as determined by the timing circuit 5 components, the timing chip 32 output voltage at terminal 36 again goes positive and the cycle is repeated.

Referring further to FIG. 2, the power supply 2 consists of a transformer 10 and a bridge rectifier 11, both suitably selected to provide a DC potential difference between terminals 12 and 13 that is compatible with other selected components. Terminal 13 is the reference ground. The size of capacitor 14 is selected to sufficiently smooth the power supply 2 output voltage. The temperature sensor 3 as depicted consists of a thermister 16 which is the only component that must be placed in a position where it is exposed to a source of heat when the heating apparatus is operational and is connected to resistors 15, 17, and 18 in a bridge circuit. The values of resistors 17 and 18 are chosen reasonably close to the resistance value of the thermistor 16 when the thermister 16 is at some nominal temperature, say 70° F. in the case of a household furnace. Resistance 15 is a variable resistance that is adjusted to provide a voltage null at terminals 19, 20 at some preselected temperature that is below the temperature selected on the heating apparatus's temperature actuated switch, or thermostat 67. For example, if it is desirable to initiate the action of the independent, self-contained electronic spark ignition recycler 1 when the temperature is 65° F., resistor 15 is adjusted to provide a voltage null at terminals 19, 20 when thermister 16 is in a 65° F. environment. When thermister 16 is then placed in an environment above the preselected temperature, the resistance across thermister 16 decreases and the voltage at terminal 20 will be positive with respect to terminal 19. When the environment in which thermister 16 decreases below the preselected temperature, the resistance across thermister 16 increases and the voltage at terminal 20 will be negative with respect to terminal 19. Terminals 19 and 20 are connected to the input of an on/off circuit which in this case is an operational amplifier 22 such as an MC1741 CP1. (Note that terminals 19, 20, 23, 24, and 25 of operational amplifier 22 are commonly referred to as terminals 3, 2, 6, 7, and 4 respectively of operational amplifier MC1741 CP1.) The output voltage at terminal 23 of the operational amplifier 22 is some positive DC voltage when terminal 20 is negative with respect to terminal 19 and is zero when terminal 20 is positive with respect to terminal 19. Terminals 24, 25 are the normal bias terminals of the operational amplifier 22 and capacitor 26 and resister 27 provide a small amount of feedback to allow smooth operation of the operational amplifier 22.

Referring again to FIG. 2, the timing circuit 5 is activated when a positive voltage at terminal 23 exists and a monolithic timing chip 32, such as an NE555, is suitably connected in this case for astable operation. (Note that terminals 34 through 41 of timing chip 32 are commonly referred to as terminals 1 thorough 8 of the NE555.) Resistors 28, 29 and diodes 30, 31 along with low loss capacitor 33 determine the length of time that a positive output voltage exists at the output terminal 36. Resistor 28 determines the time a positive voltage will exist at terminal 36 and resistor 29 determines the time zero voltage will exist at terminal 36. Either of these times can be varied from fractions of a second to many minutes—the required timing being determined by the application. When the output at terminal 36 is zero volts, the base of transistor 44 is also zero volts and transistor 44 does not conduct. With this condition, the voltage across terminals 47, 48 is zero and contact 7 is in its normal position—closed for most applications and open when the reset system of the heater apparatus 66 requires a temporary short circuit. When the output at terminal 36 is cycled to a predetermined positive voltage, the base of transistor 44 is also positive. The base current is limited primarily by resistor 42. Transistor 44 conducts and a potential difference exists across terminals 47, 48. The magnitude of this voltage is determined by the voltage at terminals 12, 13, less the voltage drop across transistor 44 and resistor 43. Contact 7 then is forced to its abnormal position —open for most applications and closed when the reset system of the heater apparatus requires a temporary short circuit. Diodes 45, 46 are included for protection against high voltage transients. The timing chip 32 in this case, being connected in an astable mode, will continue to operate and cycle the output at terminal 36 from a positive voltage to zero as long as the output at terminal 23 remains positive. Thus, this invention allows as many ignition attempts as is deemded reasonable.

Figure 3:
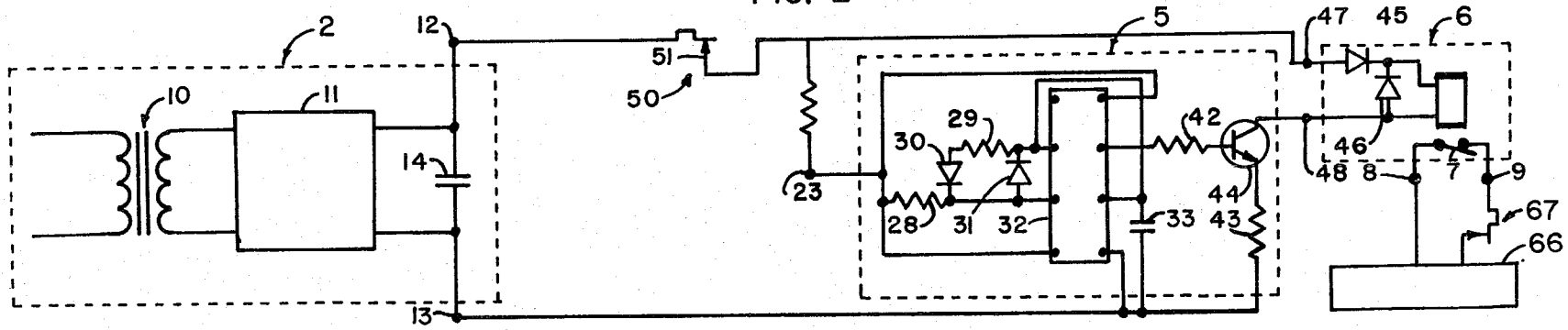
FIG. 3 shows a circuit of the present invention wherein some components required in FIG. 2 are replaced by a thermostat.

Although the temperature sensor 3 and on/off circuit 4 in FIG. 2 are shown as electronic circuits, it should be understood that the separate temperature sensor 3 and on/off circuit 4 could be replaced by a single temperature activated switch (or thermostat). Such a substitution is shown in FIG. 3. In this figure, a temperature activated switch 50 is connected such that a contact 51 is open for temperatures above a predeterminated amount and is placed in a position where it will detect an increase in temperature when the heating apparatus 66 is operational. If heater apparatus 66 ignition fails to occur, temperature activated switch 50 will also be in a position to detect a decrease in temperature below that which is selected on the thermostat 67 connected to and controlling the heating apparatus 66. Thus, if heater apparatus 66 ignition fails to occur, the temperature environment near temperature activated switch 50 falls below a predetermined value and contact 51 closes. Timing chip 32 is then activated and allowed to cycle as was previously described. If ignition occurs, a temperature rise in the environment surrounding temperature activated switch 50 causes the contact 51 to open and deactivate the independent, self contained electronic spark ignition recycler.

Figure 4:
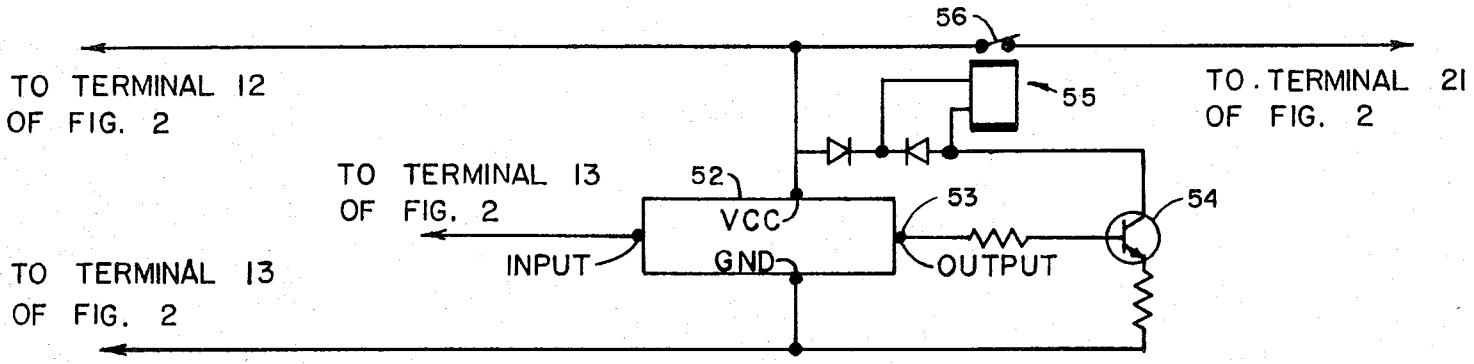
FIG. 4 shows a means for deactivating the present recycler after a predetermined number of ignition attempts.

There may be reason to limit the number of ignition attempts under the assumption that if some predetermined number of attempts fail to cause normal operation of the heater apparatus 66, then the apparatus is faulty and a latch-up mode should indeed be accepted. One method of achieving such a limitation is illustrated in FIG. 4. In this method, a divide by N counter 52, such as the use of a TCG7490 if N=10, counts the positive voltage pulses at the output terminal 36 of timing chip 32 and after the predetermined number of voltage pulses (or ignition attempts), a voltage output at terminal 53 causes transistor 54 to conduct. This action in turn actuates a triggerable bidirectional switch 55. A contact 56 of switch 55 is set for normally closed operation and replaces the direct connection between terminals 12, 21 of FIG. 2. Thus, after the predetermined number of ignition attempts, contact 56 opens the circuit between terminals 12 and 21. Thus the triggerable bidirectional switch 6 and contact 7 thereafter remain in the normally closed position.

Figure 5:
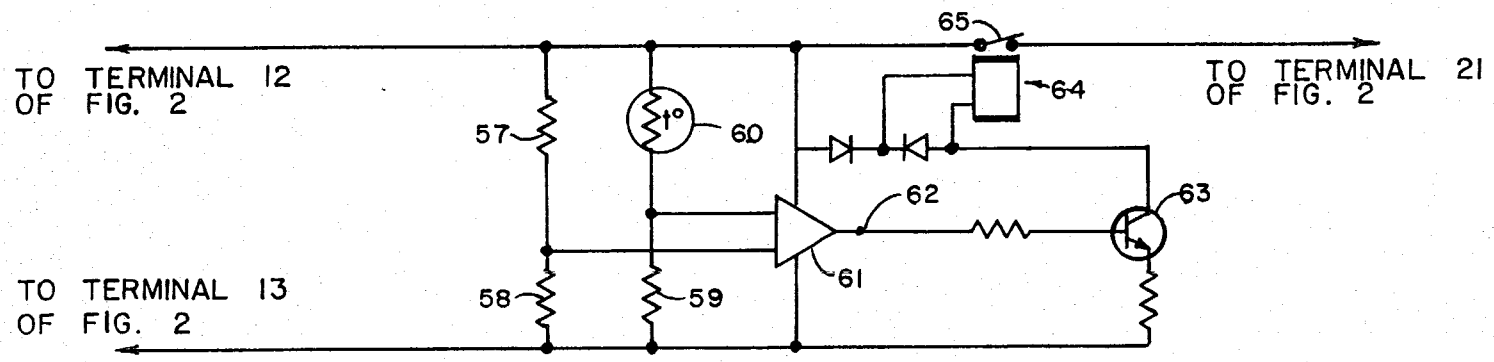
FIG. 5 shows a means for deactivating the present recycler after a predetermined temperature drop has occurred.

Referring to FIG. 5, a second method of achieving a limitation on the number of ignition attempts, a method that can be used in conjunction with the aforementioned counting method, is to incorporate a second thermister 60 collocated with thermister 16, but in a circuit that will inactivate the independent, self contained electronic spark ignition recycler when the temperature falls below a predetermined amount. For example, if the voltage null between terminals 19, 20 of the bridge circuit in FIG. 2 is set to occur at 65° F., the voltage null of a second bridge may be set to occur at 50° F. FIG. 5 provides the circuit used for incorporating this means. In this figure, the operation of resistors 57, 58, 59, thermister 60, and an operational amplifier 61 operate exactly as was previous explained for obtaining the output of operational amplifier 22. However, as stated, the output voltage at terminal 62 of the operational amplifier 61 switches states from zero to some positive voltage at a lower temperature than does operational amplifier 22 in FIG. 2. The output of the operational amplifier 61 drives a transistor 63 which in turn activates a triggerable bidirectional switch 64 whose contact 65 is normally closed and replaces the direct electrical connection between terminals 12 and 21 of FIG. 2. Contact 65 opens and inactivates the independent, self contained electronic spark ignition recycles.

What is claimed is:

1. In a heating apparatus that relies on an electronic spark ignition system, the system being such that the system's logic will be recycled to its initial state by temporarily lowering the system's temperature activated switch (or thermostat), by temporarily interrupting a power source or control line, or by short circuiting a specific control line, the improvement comprising: an independent, self-contained, easily installed electronic spark ignition recycler means that periodically causes the electronic ignition to attempt a heater apparatus ignition if a previous attempt failed to achieve ignition and proper operation, the recycler means including a power supply means to allow the recycler means to be self contained, a termperature sensor means for allowing the recycler means to be activated or deactivated independently of the logic or electronics contained in the heater apparatus, a timing circuit means for providing periodic positive voltage pulses of predetermined time which determines a time allocated for recycling, an on/off circuit means for activating and deactivating the timing circuit means according to the needs of the temperature sensor means, a bidirectional switch means responsive to said voltage pulse to cause said system's logic to recycle to its initial state, and a means for deactivating the recycler after a predetermined number of ignition attempts have been made or after a predetermined temperature drop has occured.

2. The improvement as recited in claim 1 wherein said temperature sensor means determines a lack of heater system ignition.

3. The improvement as recited in claim 2 further comprising means for electrically coupling the temperature sensor means to the timing circuit means through the on/off circuit means.

4. The improvement as recited in claim 1 wherein the means for deactivating the recycler after a predetermined number of ignition attempts comprises a divide by N counter which counts said periodic voltage pulses.

5. The improvement as recited in claim 1 wherein the means for deactivating the recycler after a predetermined temperature drop comprises a second temperature sensor means.

6. The improvement as recited in claim 1 wherein said timing circuit means is astable.

7. In a heating apparatus that relies on an electronic spark ignition system, the system being such that the system's logic will be recycled to its initial state by temporarily lowering the system's temperature activated switch (or thermostat), by temporarily interrupting a power source or control line, or by short circuiting a specific control line, the improvement comprising: a spark ignition recycler means that periodically causes the electronic ignition to attempt a heater apparatus ignition if a previous attempt failed to achieve ignition and proper operation, the recycler means including a temperature sensor means for allowing the recycler means to be activated or deactivated independently of the logic or electronics contained in the heater apparatus, a timing circuit means for providing periodic positive voltage pulses of predetermined time which determines a time allocated for recycling, an on/off circuit means for activating and deactivating the timing circuit means according to the needs of the temperature sensor means, a bidirectional switch means responsive to said voltage pulse to cause said systems's logic to recycle to its initial state, and a means for deactivating the recycler after a predetermined temperature drop has occurred.

8. In a heating apparatus that relies on an electronic spark ignition system, the system being such that the system's logic will be recycled to its initial state by temporarily lowering the system's temperature activated switch (or thermostat), by temporarily interrupting a power source or control line, or by short circuiting a specific control line, the improvement comprising: a spark ignition recycler means that periodically causes the electronic ignition to attempt a heater apparatus ignition if a previous attempt failed to achieve ignition and proper operation, the recycler means including a temperature sensor means for allowing the recycler means to be activated or deactivated independently of the logic or electronics contained in the heater apparatus, a timing circuit means for providing periodic positive voltage pulses of predetermined time which determines a time allocated for recycling, an on/off circuit means for activating and deactivating the timing circuit means according to the needs of the temperature sensor means, a bidirectional switch means responsive to said voltage pulse to cause said system's logic to recycle to its initial state, and a means for deactivating the recycler after a predetermined number of ignition attempts have been made.

* * * * *